US010624402B2

(12) United States Patent
Kim et al.

(10) Patent No.: US 10,624,402 B2
(45) Date of Patent: Apr. 21, 2020

(54) CURLED BRAID APPARATUS AND METHOD OF MANUFACTURING SAME

(71) Applicant: SHAKE-N-GO FASHION, INC., Port Washington, NY (US)

(72) Inventors: James K. Kim, Manhasset, NY (US); Peter Ough, Manhasset, NY (US); Hye Sun Kim, Port Washington, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 499 days.

(21) Appl. No.: 15/446,456

(22) Filed: Mar. 1, 2017

(65) Prior Publication Data

US 2017/0251739 A1 Sep. 7, 2017

Related U.S. Application Data

(60) Provisional application No. 62/301,940, filed on Mar. 1, 2016.

(51) Int. Cl.
*A41G 3/00* (2006.01)
*A41G 5/00* (2006.01)

(52) U.S. Cl.
CPC ..... *A41G 3/0075* (2013.01); *A41G 5/0046* (2013.01)

(58) Field of Classification Search
CPC ..... A45D 2007/004; A45D 2007/005; A41G 3/0075; A41G 5/0046; A41G 5/004
See application file for complete search history.

(56) References Cited

U.S. PATENT DOCUMENTS

| | | | |
|---|---|---|---|
| 2,531,685 | A | 11/1950 | Jacoby |
| 3,910,291 | A | 10/1975 | Kim |
| 4,369,690 | A | 1/1983 | Sapkus |
| 4,982,748 | A | 1/1991 | Trimarchi |
| 5,634,478 | A | 6/1997 | Shakir |
| 5,758,670 | A | 6/1998 | Ogunro |
| 5,899,211 | A | 5/1999 | Brown |
| 6,109,275 | A | 8/2000 | Mendezmonsanto |
| 2003/0159705 | A1 | 8/2003 | Ferguson |

(Continued)

FOREIGN PATENT DOCUMENTS

RU 2473294 C1 1/2013

OTHER PUBLICATIONS

International Search Report, for International application No. PCT/US2017/020154.

*Primary Examiner* — Rachel R Steitz
(74) *Attorney, Agent, or Firm* — Cowan, Liebowitz & Latman, P.C.; Mark Montague; Brian R. Volk

(57) ABSTRACT

A method of manufacturing a curled hair braid apparatus comprising: providing a length of artificial hair; forming a loop section, a first hair prong and a second hair prong, wherein the first hair prong comprises a first hair prong end and the second hair prong comprises a second hair prong end; rotating the first hair prong; rotating the second hair prong; wrapping the first hair prong around the second hair prong along at least a portion of the length of the artificial hair; separating a third hair prong from the second hair prong; wrapping the first hair prong behind the third hair prong and in front the second hair prong; wrapping the third hair prong behind the second hair prong and in front of the first hair prong; and wrapping the second hair prong behind the first hair prong and in front of the third hair prong.

7 Claims, 4 Drawing Sheets

(56) References Cited

U.S. PATENT DOCUMENTS

| | | | | |
|---|---|---|---|---|
| 2010/0040807 | A1 | 2/2010 | Horihata | |
| 2011/0220136 | A1 | 9/2011 | Kang | |
| 2014/0083445 | A1 | 3/2014 | Wright et al. | |
| 2017/0215505 | A1* | 8/2017 | Shin | A41G 3/00 |

* cited by examiner

CURLED BRAID APPARATUS AND METHOD OF MANUFACTURING SAME

CROSS REFERENCE TO RELATED APPLICATION

This application claims priority to U.S. Provisional Patent Application No. 62/301,940 filed on Mar. 1, 2016, the entire content of which is incorporated herein by reference.

BACKGROUND

1. Field of the Invention

The present invention relates generally to artificial hair, and more particularly, to a curled hair braid apparatus and method of manufacturing the curled hair braid apparatus.

2. Related Art

Crochet cap-style wigs are desirable to consumers. A crochet cap wig generally includes a mesh cap configured to fit around a human head and a filament attached to the mesh cap according to a predetermined pattern. The filament may be, for example, a braid of synthetic hair that traverses the mesh cap from one side to the other in multiple rows. Bundles of hair are folded in half to form a loop and then the loop is crocheted to the filament.

Some users prefer to attach hair bundles of hair directly to their scalp using crocheting methods. For example, some users braid their hair tightly to their scalp in, for example, what is referred to as a corn row, and then crochet bundles of hair to the braid on the users' scalp. This can also be accomplished by covering the user's natural scalp with a mesh cap that has artificial braids, or some other suitable point of attachment, for crocheting the bundles of hair to the user's scalp. The crochet-style hair attachment products provide the user with the ability to attach artificial hair to their scalp according to their own style and preference.

When using artificial hair products, users prefer to have the most natural-appearing products in their hair. Braided bundles of artificial hair that can be crocheted to a user's scalp or a mesh cap typically do not have a natural appearance. This is because artificial hair that is braided tends to not have natural-appearing volume. In order to compensate for the lack of volume in artificial hair braids, four-pronged braids are often used. The four prongs, with each prong including multiple strands of hair, are braided to compensate for the reduced volume and unnatural appearance of braided artificial hair. These four-prong hair braids made from artificial hair that attempt to match the volume of natural hair use greater amounts of artificial hair to compensate for the lack of volume present in artificial hair. Use of more artificial hair to compensate of the lack of volume incurs added cost of materials during manufacturing and results in a heavier, and therefore, less desirable product.

SUMMARY OF THE INVENTION

A method of manufacturing a curled hair braid apparatus is provided. The method comprises: providing a length of artificial hair; forming a loop section, a first hair prong and a second hair prong, wherein the first hair prong comprises a first hair prong end and the second hair prong comprises a second hair prong end; rotating the first hair prong by a first predetermined number of degrees; rotating the second hair prong by a second predetermined number of degrees; wrapping the first hair prong around the second hair prong a predetermined number of times along at least a portion of the length of the artificial hair; separating a third hair prong from the second hair prong; wrapping the first hair prong behind the third hair prong and in front the second hair prong; wrapping the third hair prong behind the second hair prong and in front of the first hair prong; and wrapping the second hair prong behind the first hair prong and in front of the third hair prong.

According to further embodiments: the method comprises repeating the steps of wrapping the first hair prong behind the third hair prong and in front the second hair prong, wrapping the third hair prong behind the second hair prong and in front of the first hair prong, and wrapping the second hair prong behind the first hair prong and in front of the third hair prong until at least a portion of the artificial hair is braided; the steps of wrapping the first hair prong behind the third hair prong and in front the second hair prong, wrapping the third hair prong behind the second hair prong and in front of the first hair prong, and wrapping the second hair prong behind the first hair prong and in front of the third hair prong are sequentially repeated until at least a portion of the artificial hair is braided; the method comprises securing the first hair prong end and the second hair prong end such that the first predetermined number of degrees of rotation, the second predetermined number of degrees of rotation, and the predetermined number of times of wrapping are maintained for a predetermined length of time after wrapping the first hair prong around the second hair prong; the method comprises heating the first hair prong around the second hair prong after securing the first hair prong end and the second hair prong end; the method comprises releasing the first hair prong end from the second hair prong end after wrapping the first hair prong around the second hair prong and before separating the third hair prong from the second hair prong; the loop section is secured in a fixed position; the first predetermined number of degrees and the second predetermined number of degrees are about 90 degrees to about 270 degrees; and the first hair prong and the second hair prong are maintained in a rotated configuration while wrapping the first hair prong around the second hair prong.

In an additional embodiment, a curled hair braid apparatus is provided. The apparatus comprises: a length of artificial hair comprising a loop section and a braided section; the braided section comprising a first hair prong, a second hair prong, and a third hair prong; the first hair prong comprising a plurality of first hair curls; the second hair prong comprising a plurality of second hair curls; and the third hair prong comprising a plurality of third hair curls, wherein the first hair curls on the first hair prong are configured to interlock with the second hair curls on the second hair prong and the third hair curls on the third hair prong, the hair second curls on the second hair prong are configured to interlock with the first hair curls on the first hair prong and the third hair curls on the third hair prong and the third hair curls on the third hair prong are configured to interlock with the first hair curls on the first hair prong and the second hair curls on the second hair prong.

According to further embodiments: the loop section is disposed along the length of the artificial hair, with the first hair prong and the second hair prong on one side of the loop section and the third hair prong on the other side of the loop section; the first hair prong, the second hair prong and the third hair prong are configured in a braided configuration in the braided section; the braided section comprises a first braided section, a second braided section and a third braided section, and wherein in the first braided section the first hair prong is disposed behind the third hair prong and in front the second hair prong, in the second braided section the third hair prong is disposed behind the second hair prong and in front of the first hair prong, and in the third braided section the second hair prong is disposed behind the first hair prong and in front of the third hair prong; the first braided section, the second braided section and the third braided section are sequentially repeated; the artificial hair of each of the first hair prong, the second hair prong and the third hair prong are rotated about 180 degrees; and the braided section is configured with less than four prongs of artificial hair.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

Figure 1:
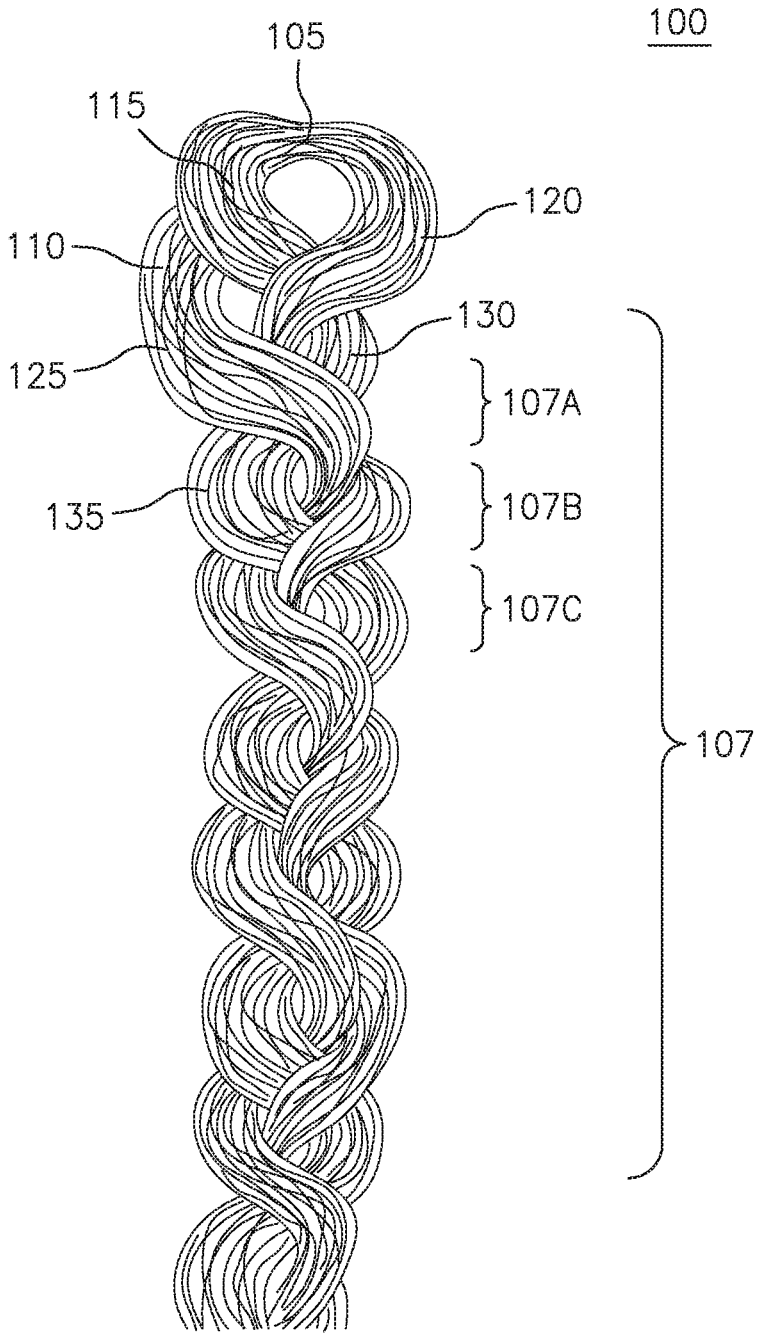
FIG. 1 illustrates a braided bundle of hair, according to an embodiment of the present invention.

The following detailed description of certain embodiments will be made in reference to the accompanying drawings. In the detailed description, explanation about related functions or constructions known in the art are omitted for the sake of clearness in understanding the concept of the invention and to avoid obscuring the invention with unnecessary detail. Reference to individual embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated Embodiments of the invention, as further described herein, provide advantages over conventional artificial hair braids. The embodiments described herein include artificial hair braids, methods of manufacturing artificial hair braids, kits for assembling artificial hair braids, methods of assembling kits for artificial hair braids, and packaging for artificial hair braids.

The phrase "artificial hair," as used herein, refers to synthetic hair products and may be embodied in various traditional hair colors, such as black, brown, blonde, and red, as well as non-traditional hair colors, such as blue, green, and purple, and combinations thereof, including individual strands of hair having two or more colors.

The term "user," as used herein, refers to any purchaser of the artificial hair apparatuses configured according to any of the embodiments disclosed herein, including, but not limited to, individual members of the public, wholesale distributors, retail merchants, manufacturers, importers and exporters of the wig and related components of the wig.

Embodiments of the present invention provide users with an artificial hair braid, and method of manufacturing the same, that embodies improved volume and, therefore, a more-natural appearance than conventional artificial hair braids. Conventional artificial hair braids made from straight, e.g., non-curled, artificial hair lack the desirable volume of a braid of natural hair and result in what is referred to as a "flat" braid. According to the configuration of the artificial hair apparatus described herein, a bundle of braided artificial hair is provided that exhibits increased volume and resembles the volume of a braid of natural hair. That is, the bundle of braided artificial hair embodies more of a three-dimensional structure as opposed to conventional artificial hair braids, which lack volume and lay flat. For example, the width of the bundle of braided artificial hair may be similar to the depth of the bundle of braided artificial hair when viewed from the front. Furthermore, a method of manufacturing the braided bundle of hair with increased volume is provided. The method of manufacturing reduces the cost of materials for manufacturing the bundle of braided hair by using a lesser amount of artificial hair than conventional braids made from artificial hair.

In accordance with embodiments of the present invention further described herein, artificial hair is first curled and is thereafter braided. In particular, a method of manufacturing a braided bundle of hair in accordance with the present invention, includes a rotating step, a wrapping step, and a braiding step. In the rotating and wrapping steps, separate prongs of straight artificial hair are rotated and then wrapped around each other. Wrapping the artificial hair secures the rotation of the prongs of artificial hair. The rotated and wrapped hair is held in this state for a period of time sufficient to allow the artificial hair to curl. The curled bundle of artificial hair is then braided. This method of curling and then braiding artificial hair provides a braided bundle of artificial hair that exhibits the volume of a braid of natural hair providing a user with a desirable appearance without requiring the added expense of purchasing natural hair. The braided bundle of hair can then be attached to a user's scalp by either crocheting the braided bundle of hair directly to the user's scalp, or, by crocheting the braided bundle of hair to a crochet-style wig.

FIG. 1 illustrates a curled hair braid apparatus 100, according to an embodiment of the present invention. The curled hair braid apparatus 100 is a bundle of artificial hair and includes a length of artificial hair including a loop section 105 and a braided section 107. The braided section 107 includes a first hair prong 110, a second hair prong 115, and a third hair prong 120. The loop section 105 is disposed along approximately the middle of the length of the artificial hair, with the first hair prong 110 and the second hair prong 115 on one side of the loop section 105 and the third hair prong 120 on the other side of the loop section 105. The first hair prong 110 includes multiple first hair curls 125. The second hair prong 115 includes multiple second hair curls 130. The third hair prong 120 includes multiple third hair curls 135. The hair curls on each of the first hair prong 110, the second hair prong 115, and the third hair prong 120 repeat a predetermined number of times along at least a portion of the length thereof.

In certain embodiments, the hair curls may repeat along the entire length of the first hair prong 110, the second hair prong 115, and the third hair prong 120. The hair curls on each of the first hair prong 110, the second hair prong 115, and the third hair prong 120 increase the volume of the curled hair braid apparatus 100, providing a natural and desirable appearance. Braiding straight artificial hair, i.e., non-curled artificial hair, results in a braid that is flat and lacks the volume of braids constructed of natural hair.

The hair curls on the first hair prong 110 are configured to interlock with the hair curls on the second hair prong 115 and the third hair prong 120 as the first hair prong 110 is braided along the length of the braided section 107 with the second hair prong 115 and the third hair prong 120. Similarly, the hair curls on the second hair prong 115 are configured to interlock with the hair curls on the first hair prong 110 and the third hair prong 120 and the hair curls on the third hair prong 120 are configured to interlock with the hair curls on the first hair prong 110 and the second hair prong 115.

As illustrated in FIG. 1, the first hair prong 110, the second hair prong 115 and the third hair prong 120 are configured in a braided configuration in the braided section 107. It is noted that "braided configuration" refers to the structural relationship of each of the first hair prong 110, the second hair prong 115 and the third hair prong 120 to one another. The braided section 107 includes a first braided section 107A, a second braided section 107B and a third braided section 107C. In the first braided section 107A, the first hair prong 110 is disposed behind the third hair prong 120 and in front the second hair prong 115. In the second braided section 107B, the third hair prong 120 is disposed behind the second hair prong 115 and in front of the first hair prong 110. In the third braided section 107C, the second hair prong 115 is disposed behind the first hair prong 110 and in front of the third hair prong 120.

In certain embodiments, the first braided section 107A, the second braided section 107B and the third braided section 107C are sequentially repeated. That is, the first braided section 107A, the second braided section 107B and the third braided section 107C are configured as described above, and at the end of the first occurrence of the third braided section 107C, the configuration of the first braided section 107A occurs a second time, followed by the second braided section 107B and next the third braided section 107C. This sequence of the first braided section 107A, the second braided section 107B and the third braided section 107C may continue until the entire length of the artificial hair is braided.

In certain embodiments, the curled hair braid apparatus 100 is tapered at an end thereof. That is, the diameter of the end of the curled hair braid apparatus 100 is less than the diameter of the braided section 107. In certain embodiments, the braided section 107 gradually tapers towards the end of the braided section 107.

In certain embodiments, the first hair prong 110, the second hair prong 115 and the third hair prong 120 are disposed in a rotated configuration. For example, the first hair prong 110, the second hair prong 115 and the third hair prong 120 are rotated about 180 degrees. It is noted that the "rotated configuration" refers to the structural orientation of the first hair prong 110, the second hair prong 115 and the third hair prong 120. In certain embodiments, the first hair prong 110, the second hair prong 115 and the third hair prong 120 may be rotated to 45, 90, 135, 180, 225, 270, 315 and 360 or more degrees of rotation.

In certain embodiments, the curled hair braid apparatus 100 includes less than four hair prongs and in a further embodiment does not have four hair prongs. In order to obtain added, more natural appearing artificial hair braids, conventional products have attempted to use four prong braids to compensate for the lack of volume of the artificial hair.

A variety of different types of braid styles can be utilized according to embodiments of the invention described herein. The braid style described with respect to the method of manufacturing the braided bundle of artificial hair below is for example only and the invention should not be considered as limited thereto.

Figure 2:
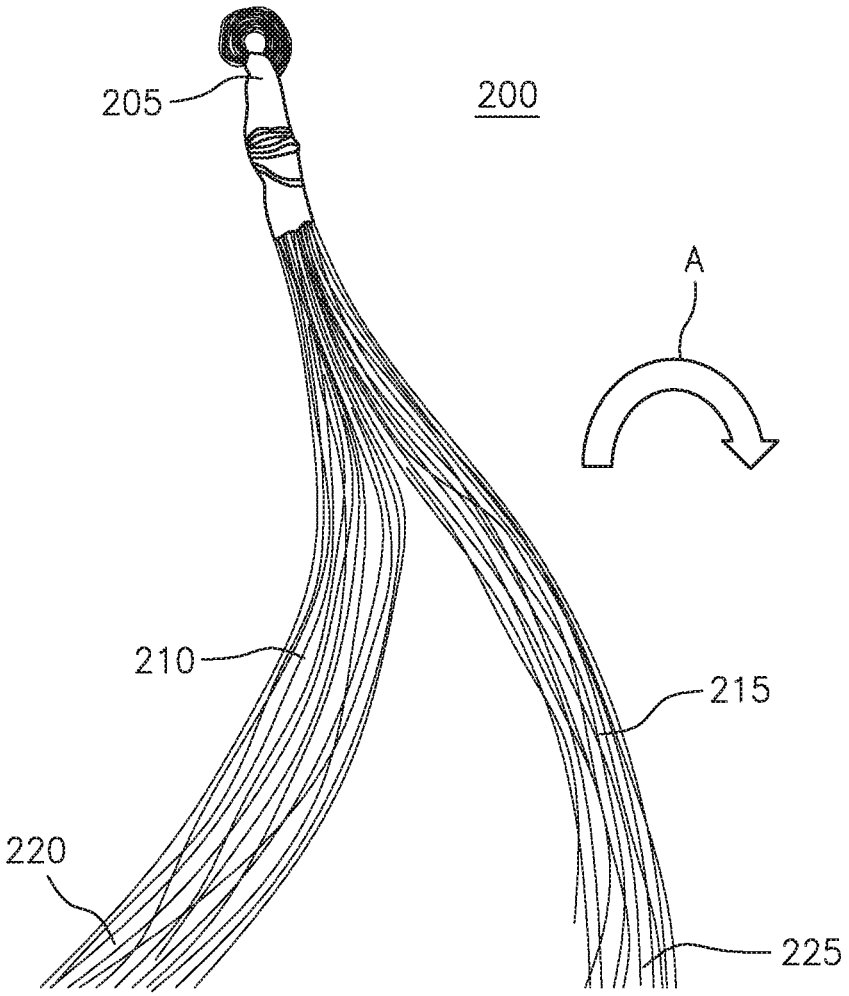
FIG. 2 illustrates a step of rotating multiple hair prongs in order to manufacture a braided bundle of hair, according to an embodiment of the present invention.
Figure 3:
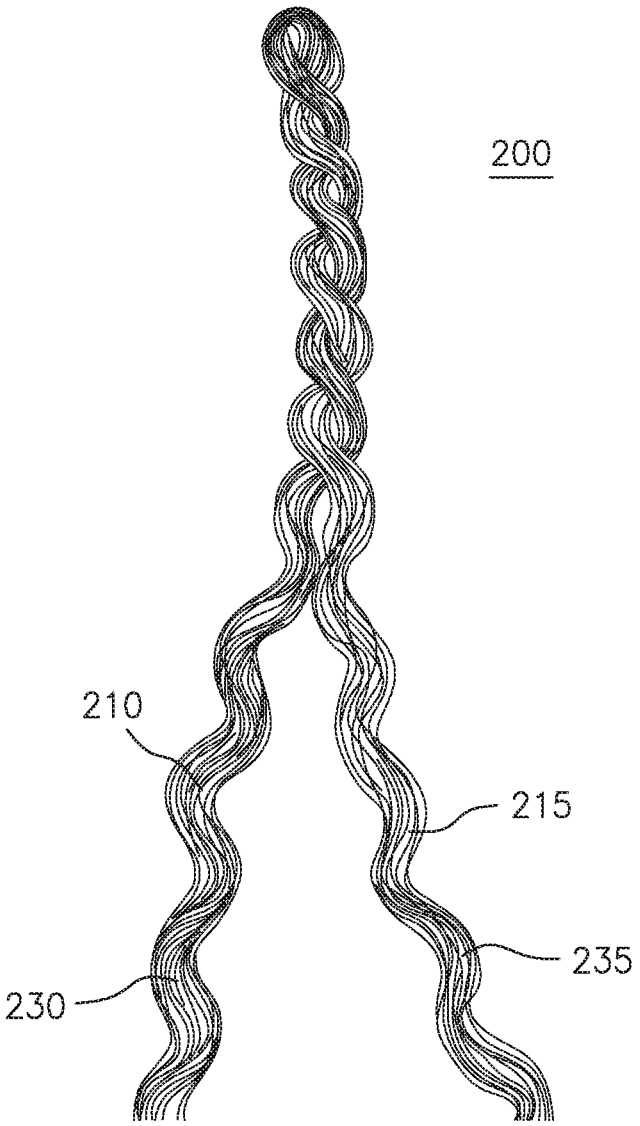
FIG. 3 illustrates a step of wrapping multiple hair prongs in order to manufacture a braided bundle of hair, according to an embodiment of the present invention.
Figure 4:
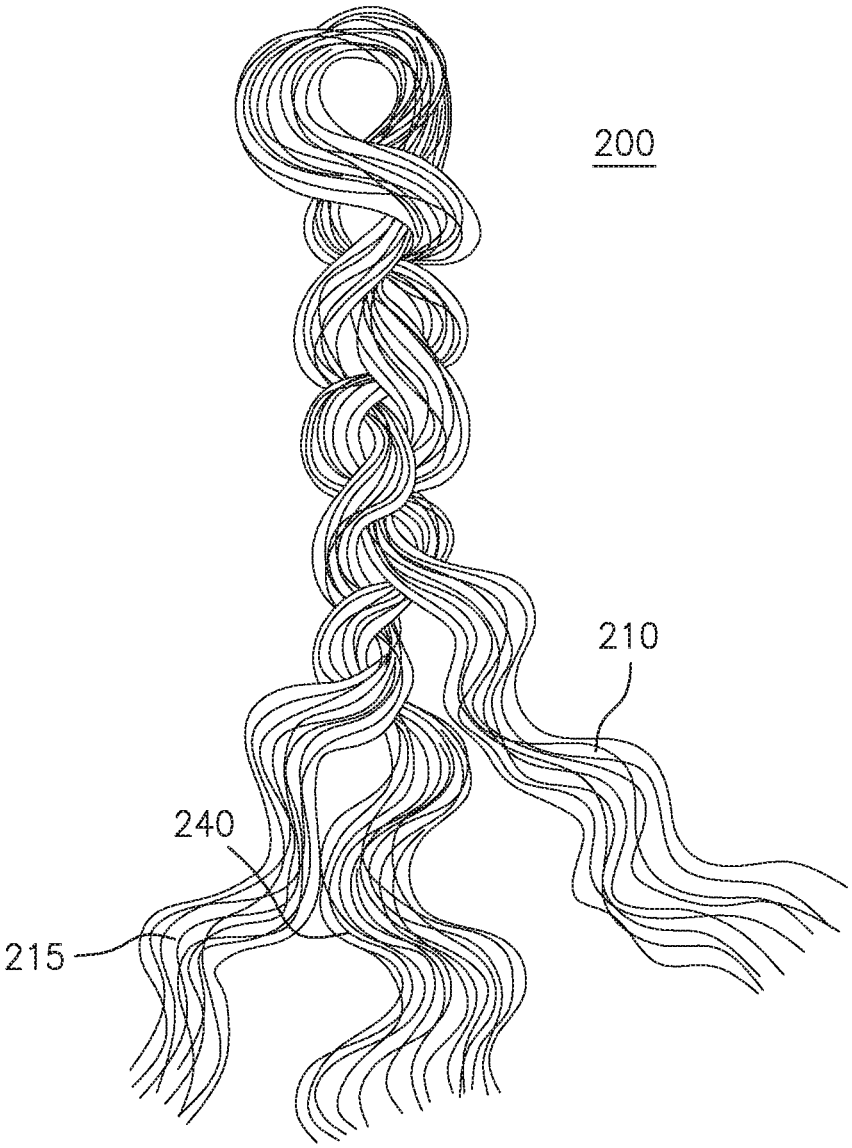
FIG. 4 illustrates a step of braiding multiple hair prongs in order to manufacture a braided bundle of hair, according to an embodiment of the present invention.

FIGS. 2-4 illustrate a method of manufacturing a curled hair braid apparatus 200 according to an embodiment of the present invention. The curled hair braid apparatus 200 can be manufactured by hand or by an appropriate machine. FIG. 2 illustrates a step of rotating multiple hair prongs in order to manufacture the curled hair braid apparatus 200, according to an embodiment of the present invention. As illustrated in FIG. 2, the method of manufacturing includes providing a length of artificial hair and then forming a loop section 205, a first hair prong 210 and a second hair prong 215. The loop section 205 is formed by bending the curled hair braid apparatus 200 at a predetermined position along the length of the artificial hair, which is generally in the middle of the bundle of artificial hair 200, but may be at any position along the length thereof. The loop section 205 is secured in a fixed position.

In certain embodiments, the loop section 205 is secured in the fixed position throughout the manufacture of the curled hair braid apparatus 200. For example, the loop section 205 may be placed over a cylindrical rod such that the first hair prong 210 is disposed on one side of the rod and the second hair prong 215 is disposed on the other side of the rod.

The first hair prong 210 includes a first hair prong end 220. The second hair prong 215 includes a second hair prong end 225. In certain embodiments, the first hair prong end 220 and the second hair prong end 225 are tapered. That is, the diameter of the first hair prong end 220 and the second hair prong end 225 is less than the diameter of the first hair prong 210 and the diameter of the second hair prong 215, respectively. In certain embodiments, the first hair prong 210 and the second hair prong 215 gradually taper towards the first hair prong end 220 and the second hair prong end 225.

The method further includes rotating the first hair prong 210 by a first predetermined number of degrees and rotating the second hair prong 215 by a second predetermined number of degrees. The first and second predetermined number of degrees can be 45, 90, 135, 180, 225, 270, 315 and 360 or more degrees of rotation. In certain embodiments, the first and second predetermined number of degrees is about 180 degrees. In certain embodiments, the first and second predetermined number of degrees is about 90 degrees to about 270 degrees. The first and second predetermined number of degrees may be the same value or may be different values. Arrow A illustrates the direction about which the first hair prong 210 and the second hair prong 215 are rotated, which is clock-wise. In certain embodiments, the first hair prong 210 and the second hair prong 215 may be rotated counter clock-wise. The first hair prong 210 and the second hair prong 215 may be rotated simultaneously or may be rotated sequentially.

FIG. 3 illustrates a step of wrapping multiple hair prongs in order to manufacture the curled hair braid apparatus 200, according to an embodiment of the present invention. With the first hair prong 210 and the second hair prong 215 maintained in a rotated configuration, the first hair prong 210 and the second hair prong 215 are then wrapped around each other. The steps of rotating the first hair prong 210 and the second hair prong 215 the first and second predetermined number of degrees, respectively, and wrapping the first hair prong 210 and the second hair prong 215 around each other are repeated a predetermined number of times along at least a portion of the length of the artificial hair of the curled hair braid apparatus 200, as illustrated in FIG. 3. In an embodiment, the rotating and wrapping steps of the first hair prong 210 and the second hair prong 215 are repeated along the entire length of the curled hair braid apparatus 200.

The first hair prong end 220 and the second hair prong end 225 are secured by, for example, tying, such that the artificial hair remains in a rotated and wrapped configuration for a predetermined length of time. In other words, the first hair prong end 220 and the second hair prong end 225 are secured such that the first predetermined number of degrees of rotation, the second predetermined number of degrees of rotation, and the predetermined number of times of wrapping are maintained for the predetermined length of time. The predetermined length of time for the rotated and wrapped state is long enough to curl the curled hair braid apparatus 200. That is, the predetermined length of time is measured from the time that the first hair prong end 220 and the second hair prong end 225 are secured together until the first hair prong end 220 and the second hair prong end 225 are untied from each other. In an embodiment, the curled hair braid apparatus 200 is heated to set the curl of the first hair prong 210 and the second hair prong 215. When the first hair prong end 220 and the second hair prong end 225 are released, e.g., untied, the first hair prong 210 includes multiple first hair curls 230 and the second hair prong 215 includes multiple second hair curls 235. The heating step ensures that the first hair curls 230 and the second hair curls 235 remain intact and do not straighten after the first hair prong end 220 and the second hair prong end 225 are released.

The rotating and wrapping steps described above provide the first hair curls 230 and the second hair curls 235, which, after the braiding steps described below with respect to FIG. 4, provide additional volume to the resulting braid. The tighter the first hair prong 210 and the second hair prong 215 are rotated and wrapped, the smaller the resulting curl of the first hair curls 230 and the second hair curls 235. Smaller first hair curls 230 and second hair curls 235 result in a braid that is smaller in width. Thus, the rotating and wrapping steps described above may be modified to provide a braid of larger or smaller width.

FIG. 4 illustrates a step of braiding multiple hair prongs in order to manufacture the curled hair braid apparatus 200, according to an embodiment of the present invention. The method of manufacturing the curled hair braid apparatus 200 further includes, after releasing the first hair prong end 220 and the second hair prong end 225, separating a third hair prong 240 away from the second hair prong 215. Separating the third hair prong 240 from the second hair prong includes dividing the second hair prong into separate portions of artificial hair. In certain embodiments, the separate portions of artificial hair are approximately equal in the amount of artificial hair. The third hair prong 240 includes multiple third hair curls 245. There are now three prongs of curled artificial hair and the curled hair braid apparatus 200 can be braided. With the loop section 205 secured in a fixed position, the following steps are executed. In step 1, the first hair prong 210 is wrapped behind the third hair prong 240 and in front the second hair prong 215. In step 2, the third hair prong 240 is wrapped behind the second hair prong 215 and in front of the first hair prong 210. In step 3, the second hair prong 215 is wrapped behind the first hair prong 210 and in front of the third hair prong 240. Steps 1-3 are repeated until at least a portion of the curled hair braid apparatus 200 has been braided. In certain embodiments, steps 1-3 are sequentially repeated until at least a portion of the curled hair braid apparatus 200 is braided. In an embodiment, steps 1-3 repeated until the entire length of the curled hair braid apparatus 200 is braided. The curled hair braid apparatus 200 is then secured, e.g., tied or knotted, at an end thereof such that the braid formed in steps 1-3, including repetitions of steps 1-3, does not come undone.

Using the method of manufacturing the curled hair braid apparatus 200 described herein, a voluminous and natural-appearing hair braid made of artificial hair is provided. Conventional hair braids made from straight artificial hair lack the volume of natural hair braids. Moreover, conventional hair braids made from artificial hair that attempt to match the volume of natural hair use greater amounts of artificial hair, for example, a four prong hair braid, to compensate for the lack of volume present in artificial hair. Use of more artificial hair to compensate of the lack of volume incurs added cost of materials during manufacturing and results in a heavier, and therefore less desirable product.

While embodiments of the invention have been shown and described with reference to certain embodiments thereof, it will be understood by those skilled in the art that various changes in form and details may be made therein without departing from the spirit and scope of the invention as defined by the appended claims and equivalents thereof.

The invention claimed is:

1. A method of manufacturing a curled hair braid apparatus, the method comprising:

providing a length of artificial hair;

forming a loop section, a first hair prong and a second hair prong, wherein the first hair prong comprises a first hair prong end and the second hair prong comprises a second hair prong end;

rotating the first hair prong by a first predetermined number of degrees;

rotating the second hair prong by a second predetermined number of degrees;

wrapping the first hair prong around the second hair prong a predetermined number of times along at least a portion of the length of the artificial hair;

securing the first hair prong end and the second hair prong end such that the first predetermined number of degrees of rotation, the second predetermined number of degrees of rotation, and the predetermined number of times of wrapping are maintained for a predetermined length of time after wrapping the first hair prong around the second hair prong;

heating the first hair prong around the second hair prong after securing the first hair prong end and the second hair prong end;

separating a third hair prong from the second hair prong;

wrapping the first hair prong behind the third hair prong and in front the second hair prong;

wrapping the third hair prong behind the second hair prong and in front of the first hair prong; and wrapping the second hair prong behind the first hair prong and in front of the third hair prong.

2. The method according to claim 1, further comprising:

repeating the steps of wrapping the first hair prong behind the third hair prong and in front the second hair prong, wrapping the third hair prong behind the second hair prong and in front of the first hair prong, and wrapping the second hair prong behind the first hair prong and in front of the third hair prong until at least a portion of the artificial hair is braided.

3. The method according to claim 2, wherein the steps of wrapping the first hair prong behind the third hair prong and in front the second hair prong, wrapping the third hair prong behind the second hair prong and in front of the first hair prong, and wrapping the second hair prong behind the first hair prong and in front of the third hair prong are sequentially repeated until at least a portion of the artificial hair is braided.

4. The method according to claim 1, further comprising releasing the first hair prong end from the second hair prong end after wrapping the first hair prong around the second hair prong and before separating the third hair prong from the second hair prong.

5. The method according to claim 1, wherein the loop section is secured in a fixed position.

6. The method according to claim 1, wherein the first predetermined number of degrees and the second predetermined number of degrees are about 90 degrees to about 270 degrees.

7. The method according to claim 1, wherein the first hair prong and the second hair prong are maintained in a rotated configuration while wrapping the first hair prong around the second hair prong.

* * * * *